US006286308B1

(12) United States Patent
Yoshida et al.

(10) Patent No.: US 6,286,308 B1
(45) Date of Patent: Sep. 11, 2001

(54) DRIVE UNIT OF COOLING FAN

(75) Inventors: Nobumi Yoshida; Hiroshi Endo, both of Tochigi (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/308,306

(22) PCT Filed: Dec. 22, 1997

(86) PCT No.: PCT/JP97/04736

§ 371 Date: May 17, 1999

§ 102(e) Date: May 17, 1999

(87) PCT Pub. No.: WO98/29643

PCT Pub. Date: Jul. 9, 1998

(30) Foreign Application Priority Data

Dec. 26, 1996 (JP) ..... 8-347775

(51) Int. Cl.[7] ..... F16D 31/02
(52) U.S. Cl. ..... 60/419; 60/456; 60/484
(58) Field of Search ..... 60/484, 486, 468, 60/464, 445, 456, 419

(56) References Cited

U.S. PATENT DOCUMENTS 2,988,888 * 6/1961 Lauck ..... 60/456
3,757,524 * 9/1973 Poyner et al. ..... 60/484
4,414,809 * 11/1983 Burris ..... 60/456
4,798,050 * 1/1989 Nakamra et al. ..... 60/486
5,052,511 * 10/1991 Hunt ..... 60/468
5,561,978 * 10/1996 Buscher ..... 60/456

FOREIGN PATENT DOCUMENTS 57-6623 1/1982 (JP) .
2-132813 11/1990 (JP) .
3-225020 10/1991 (JP) .
4-112916 4/1992 (JP) .
6-330748 11/1994 (JP) .

* cited by examiner

*Primary Examiner*—F. Daniel Lopez
(74) *Attorney, Agent, or Firm*—Frishauf, Holtz, Goodman, Langer & Chick, P.C.

(57) ABSTRACT

A discharged pressurized fluid of a primary hydraulic pump 2 driven by an engine 1 is supplied to an actuator 5 through an operating valve 4. A first hydraulic rotary machine 8 for rotating a cooling fan 7 is driven to rotate by a returning pressurized fluid of the actuator 5. A second hydraulic rotary machine 9 for rotating the cooling fan 7 is driven to rotate by the discharged pressurized fluid of an auxiliary hydraulic pump 3 which is driven by the engine 1. By utilizing the returning pressurized fluid of the actuator 5, the air blowing ability of the cooling fan is made high and the wasting of engine horse power is prevented.

11 Claims, 13 Drawing Sheets

DRIVE UNIT OF COOLING FAN

TECHNICAL FIELD

The present invention relates to a system for driving a cooling fan for blowing air to a cooling object, such as a radiator for an engine coolant, an engine oil cooler, a working fluid oil cooler, a hydraulic pump and so forth of a construction machine, an industrial vehicle and so forth.

BACKGROUND ART

For cooling an engine of a construction machine, an industrial vehicle and so forth, it has been conventional to circulate a coolant for the engine to a radiator, and in conjunction therewith, to blow an air to the radiator by means of a cooling fan.

The foregoing cooling fan is mechanically driven by the engine, or, in the alternative, by a hydraulic motor which is rotated by a discharged pressurized fluid of a hydraulic pump driven by the engine.

Since the conventional cooling fan is driven by utilizing a horse power of the engine, the horse power of the engine is consumed for driving the cooling fan.

Therefore, the present invention is worked out for solving the problem set forth above, and has an object to provide a drive system of a cooling fan.

DISCLOSURE OF THE INVENTION

The first invention is a drive system for a cooling fan, comprising a primary hydraulic pump 2 driven by an engine 1, an operating valve 4 for supplying a discharged pressurized fluid of the primary hydraulic pump 2 to an actuator 5, a cooling fan 7 for blowing an air to a cooling object, a first hydraulic rotary machine 8 for rotating the cooling fan 7, a second hydraulic rotary machine 9 for rotating the cooling fan 7, a return circuit 10 for supplying a returning pressurized fluid from the operating valve 4 to the first hydraulic rotary machine 8, and a hydraulic pressure source for supplying pressurized fluid to the second hydraulic rotary machine 9.

According to the first invention, when the actuator 5 is not actuated, the second hydraulic rotary machine 9 is rotated by the pressurized fluid of the hydraulic pressure source, to thereby rotate the cooling fan 7. When the actuator 5 is actuated, the first hydraulic rotary machine 8 is rotated by utilizing the returning pressurized fluid. Thus, the cooling fan 7 is rotated by the first and second hydraulic rotary machines 8 and 9.

Thus, since the cooling fan 7 can be rotated by utilizing the returning pressurized fluid of the actuator 5, the air blowing performance of the cooling fan 7 can be made large. Also, a consumption of a horse power of the engine can be reduced.

The second invention is a drive system for a cooling fan, wherein a back pressure valve 40 is provided in the return circuit 10 in the first invention, and an upstream side of the back pressure valve 40 is connected to the first hydraulic rotary machine 8.

By the second invention, the pressure of the pressurized fluid to be supplied to the first hydraulic rotary machine 8 becomes higher than or equal to the set pressure of the back pressure valve 40. Therefore, even when the pressure of the returning pressurized fluid is low, the first hydraulic rotary machine 8 can be rotated with a drive torque higher than or equal to a predetermined torque, and the air blowing performance of the cooling fan 7 can be set at a value greater than or equal to a predetermined value.

The third invention is a drive system for a cooling fan wherein the back pressure valve 40 in the second invention, is provided with a controller that variably sets the back pressure valve 40 at high pressure when a temperature of the cooling object is high, and at low pressure when the temperature of the cooling object is low.

By the third invention, when the cooling object is at a high temperature, the pressurized fluid of high pressure flows into the first hydraulic rotary machine 8 to make an air blowing ability of the cooling fan 7 high. When the cooling object is at in low temperature, the pressurized fluid of low pressure flows into the first hydraulic rotary machine 8 to make the air blowing ability of the cooling fan 7 low.

By this, the cooling object can be cooled efficiently.

The fourth invention is a drive system for a cooling fan wherein a hydraulic pump/motor 45 is driven by the pressurized fluid of the return circuit 10 in the first invention, the variable displacement type hydraulic pump 46 is mechanically connected to the hydraulic pump/motor to form a pressure converter 44, and the discharged pressurized fluid of the variable displacement type hydraulic pump 46 is supplied to the first hydraulic rotary machine 8.

By the fourth invention, since the returning pressurized fluid of high pressure can be supplied to the first hydraulic rotary machine 8, the air blowing ability of the cooling fan 7 can be made high even when the pressure of the returning pressurized fluid is low.

The fifth invention is a drive system for a cooling fan, wherein the hydraulic pressure source of the first invention is an auxiliary hydraulic pump 3 driven by the engine 1.

By the fifth invention, the second hydraulic rotary machine 9 can be certainly rotated with the discharged pressurized fluid of the auxiliary hydraulic pump 3 which is driven by the engine 1.

The sixth invention is a drive system for a cooling fan according to the fifth invention which is further provided with a controller that sets for setting a pressure of the fluid supplied from the auxiliary hydraulic pump 3 to the second hydraulic rotary machine 9 at high pressure when the temperature of the cooling object to be cooled by the cooling fan 7 is high and at low pressure when the temperature is low.

By the sixth invention, the pressure of the pressurized fluid flowing into the second hydraulic rotary machine 9 is set at high pressure when the cooling object is at a high temperature, and at low pressure when the cooling object is at a low temperature. Therefore, when the cooling object is at a high temperature, the air blowing performance of the cooling fan 7 is high and when the cooling object is at a low temperature, the air blowing performance is low.

As set forth above, the cooling object can be cooled efficiently, and the wasting of horse power of the engine 1 can be prevented.

The seventh invention is a drive system for a cooling fan wherein a pressurized fluid inflow side of the first hydraulic rotary machine 8 and a pressurized fluid inflow side of the second hydraulic rotary machine 9 are connected to a tank 12 through a suction valve 11.

By the seventh invention, when the first and second hydraulic rotary machines 8 and 9 are operated for pumping operation, they suck the fluid from the tank 12 so as not to generate negative pressure in them.

The eighth invention is a drive system for a cooling fan according to the fifth invention wherein the first hydraulic rotary machine 8 is a turbo type rotary machine, the cooling fan 7 is a turbo fan, the second hydraulic rotary machine 9 is a gear type hydraulic motor, the turbo fan is connected to one side portion of the turbo type rotary machine, and the gear type hydraulic motor is connected to the other side portion of the turbo type rotary machine.

By the eighth invention, the cooling fan 7, the first hydraulic rotary machine 8 and the second hydraulic rotary machine 9 are connected integrally to make them compact.

On the other hand, since the cooling fan 7 is the turbo fan and the first hydraulic rotary machine 8 is the turbo rotary machine, air blowing volume of the cooling fan 7 becomes large while still being compact.

The ninth invention is a drive system for a cooling fan, wherein the hydraulic pressure source in the first invention is a branch circuit 60 connected to a discharge passage 2*a* of the primary hydraulic pump 2.

By the ninth invention, the second hydraulic rotary machine 9 can be certainly rotated by utilizing the discharged pressurized fluid of the primary hydraulic pump 2.

The tenth invention is a drive system for a cooling fan, wherein a variable pressure reduction valve 65 is provided in the branch circuit 60 in the ninth invention, and a controller is further provided to set a set pressure of the variable pressure reduction valve 65 at high pressure when the temperature of the cooling object to be cooled by the cooling fan 7 is high and at low pressure when the temperature of the cooling object is low.

By the tenth invention, the discharged pressurized fluid of the primary hydraulic pump 2 is lowered at the pressure to be supplied to the second hydraulic rotary machine 9. Therefore, while the pressurized fluid of high pressure is supplied to the actuator 5, the second hydraulic rotary machine 9 is rotated with a predetermined driving torque with supplying the pressurized fluid of low pressure thereto.

By this, the air blowing ability of the cooling fan 7 can have a predetermined magnitude irrespective of the discharge pressure of the primary hydraulic pump 2.

On the other hand, the pressure of the hydraulic pressure supplied to the second hydraulic rotary machine 9 is high pressure when the cooling object is at a high temperature, and is low pressure when the cooling object is at a low temperature.

By this, the air blowing ability of the cooling fan 7 has a magnitude corresponding to the temperature of the cooling object. Therefore, the cooling object can be cooled efficiently. Also, the wasting of the horse power of the engine can be prevented.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

BEST MODE FOR IMPLEMENTING THE INVENTION

Figure 1:
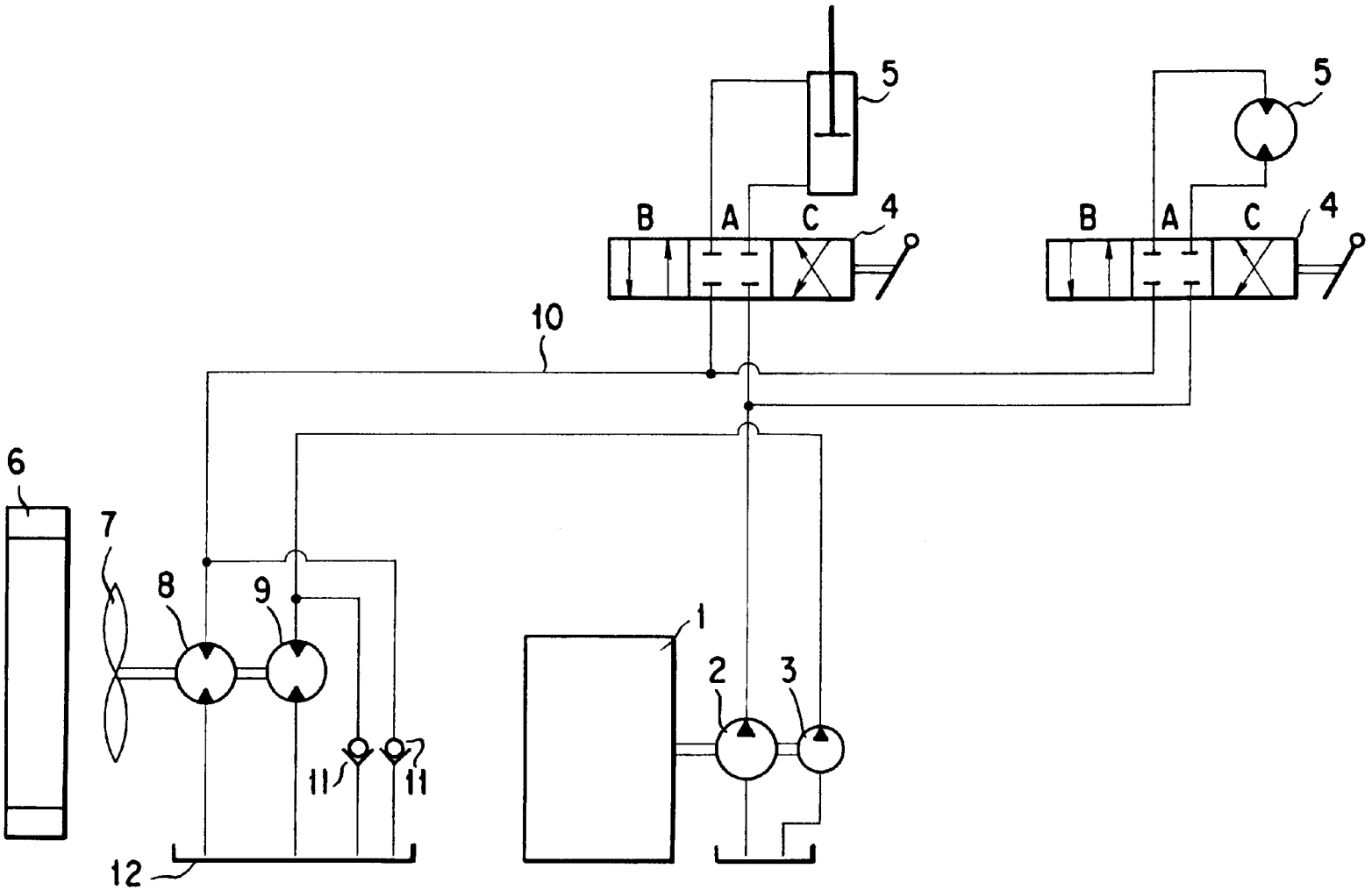
FIG. 1 is an explanatory illustration showing the first embodiment of the present invention.

As shown in FIG. 1, a primary hydraulic pump 2 and an auxiliary hydraulic pump 3 are driven by an engine 1. A discharged pressurized fluid of the primary hydraulic pump 2 is supplied to a plurality of actuators 5 by a plurality of operating valves 4.

A cooling fan 7 for blowing air to a radiator 6 is rotated by a first hydraulic rotary machine 8 and a second hydraulic rotary machine 9 which are rotated by an inflow of the pressurized fluid. The first hydraulic rotary machine 8 is rotated by a returning pressurized fluid of the actuator 5 flowing through a return circuit 10 of the operating valve 4.

The second hydraulic rotary machine 9 is rotated by a discharged pressurized fluid of the auxiliary hydraulic pump 3. A pressurized fluid inflow side of the first and second hydraulic rotary machines 8 and 9 are connected to a tank 12 through a suction valve 11.

Next, operation will be discussed.

When the discharged pressurized fluid of the primary hydraulic pump 2 is supplied to the actuator 5 by switching the operating valve 4 from a neutral position A to a first or a second position B, C, the first hydraulic rotary machine 8 is rotated by a returning pressurized fluid of the actuator 5 flowing through the return circuit 10 of the operating valve 4. Therefore, the cooling fan 7 is rotated by the first and second hydraulic rotary machines 8 and 9.

By this, air is blown to the radiator 6 by the cooling fan 7 to cool the coolant of the engine 1.

While the operating valve 4 is in the neutral position A, since the cooling fan 7 is rotated by the second hydraulic rotary machine 9, the air is blown to the radiator 6 by the cooling fan 7 to cool the coolant of the engine 1.

During the foregoing operation, if the first hydraulic rotary machine 8 is rotated at higher speed than the second hydraulic rotary machine 9, the second hydraulic rotary machine 9 performs its pumping action for sucking a fluid from the tank 12 through the suction valve 11 so as not to generate negative pressure in them.

When the second hydraulic rotary machine 9 is rotated at high speed, the first hydraulic rotary machine 8 performs its pumping operation to suck the fluid from the tank 12 through the suction valve 11 so as not to generate negative pressure in them.

As set forth above, upon actuating the actuator 5, a drive torque of the primary hydraulic pump 2 becomes large to correspondingly make the load on the engine 1 large and thus make a coolant temperature high. However, since the cooling fan is rotated by the first and second hydraulic rotary machines 8 and 9, the air blowing ability is large to sufficiently cool the coolant of the engine.

On the other hand, when the actuator 5 is not actuated, the drive torque of the primary hydraulic pump 2 becomes small. Thus, the load on the engine 1 becomes small to make the coolant temperature low. Therefore, even if the cooling fan 7 is rotated only by the second hydraulic rotary machine 9 and thus the air blowing ability is small, the coolant of the engine can be cooled sufficiently.

In the foregoing embodiment, while air is blown to the radiator 6 by the cooling fan 7 to cool the coolant of the engine, it is, of course, possible to cool a lubricant of the engine by blowing air to an engine oil cooler, to cool a working fluid of the hydraulic pump by blowing air to a working fluid cooler, or, in the alternative, to blow the air to the primary hydraulic pump 2 and the auxiliary hydraulic pump 3 to cool them. Namely, the cooling fan 7 blows air to the cooling object to cool.

Figure 2:
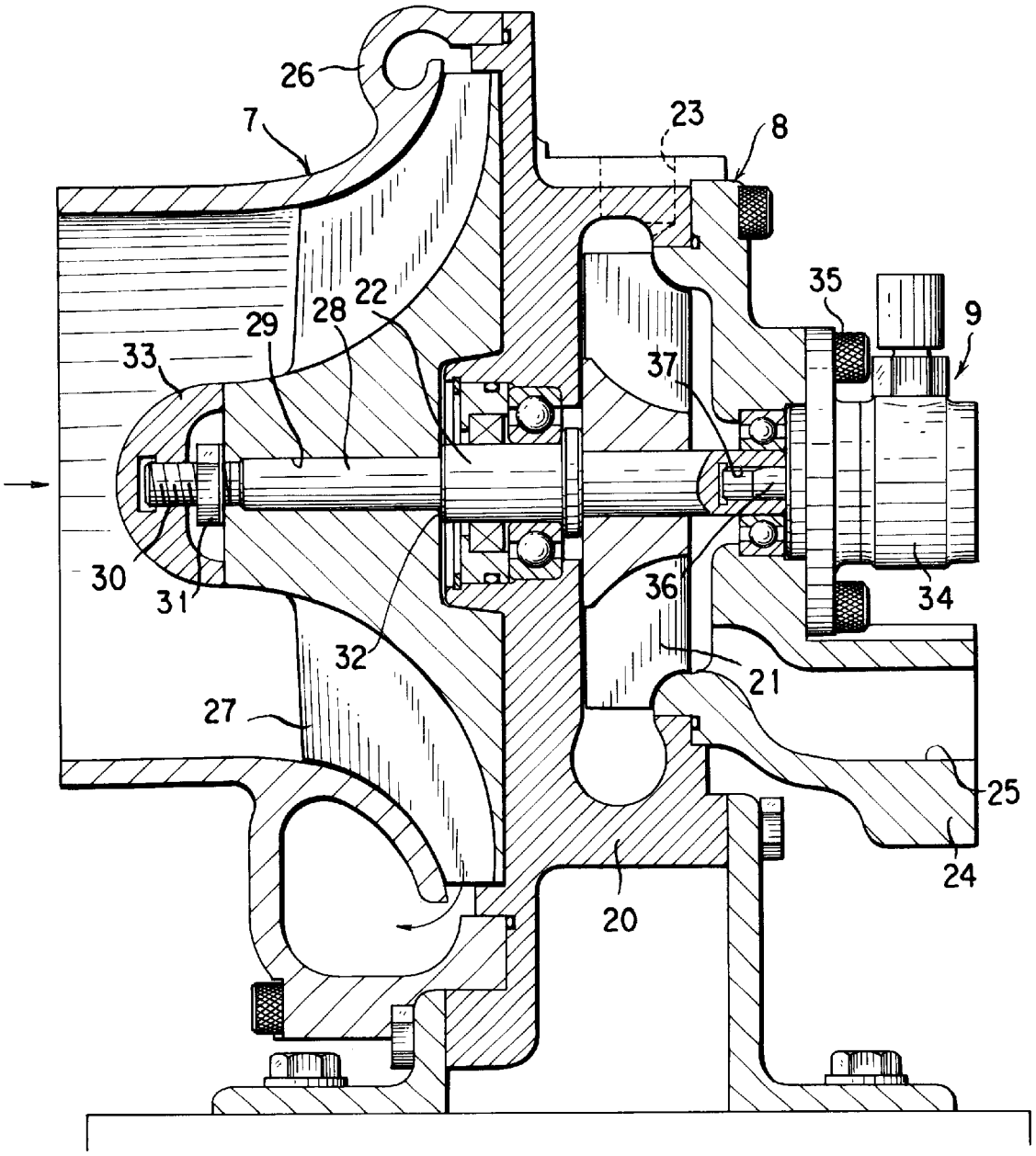
FIG. 2 is a section of a particular structure of a cooling fan, a first hydraulic rotary machine and a second hydraulic rotary machine.

As shown in FIG. 2, the first hydraulic rotary machine 8 is a turbo type rotary machine, in which turbo vanes 21 are rotatably provided within a turbo housing 20 together with a shaft 22, an inlet 23 if formed in the turbo housing 20, and an outlet 25 is formed in a turbo casing 24.

As shown in FIG. 2, the cooling fan 7 is a turbo type fan, in which fan vanes 27 are rotatably provided within a fan housing 26 which is coupled with the turbo housing 20, together with a shaft 28, for blowing air in a direction shown by an arrow.

The foregoing shaft 28 is integral with the shaft 22 of the turbo type rotary machine to externally project through a shaft hole 29 of the fan vanes 27. Then, by threadingly engaging a nut 31 to a threaded portion 30, the fan vanes 27 is pressed onto a step portion 32 to be secured. The reference numeral 33 denotes a cap.

The second hydraulic rotary machine 9 is a gear type hydraulic motor. A motor casing 34 is coupled with the turbo casing 24 by means of bolts 35. A shaft 36 engages with a spline hole 37 of the shaft 22.

As set forth above, the cooling fan 7, the first hydraulic rotary machine 8 and the second hydraulic rotary machine 9 are connected integrally to make the total volume compact.

On the other hand, since the first hydraulic rotary machine 8 is a turbo type rotary machine, it rotates at higher speed relative to the flow of the inflow pressurized fluid. Also, since the cooling fan 7 is a turbo type fan, air blowing volume per rotation is large. Therefore, despite having a compact overall size, the air blowing volume of the cooling fan 7 is still large.

Next, other embodiments will be discussed.

Figure 3:
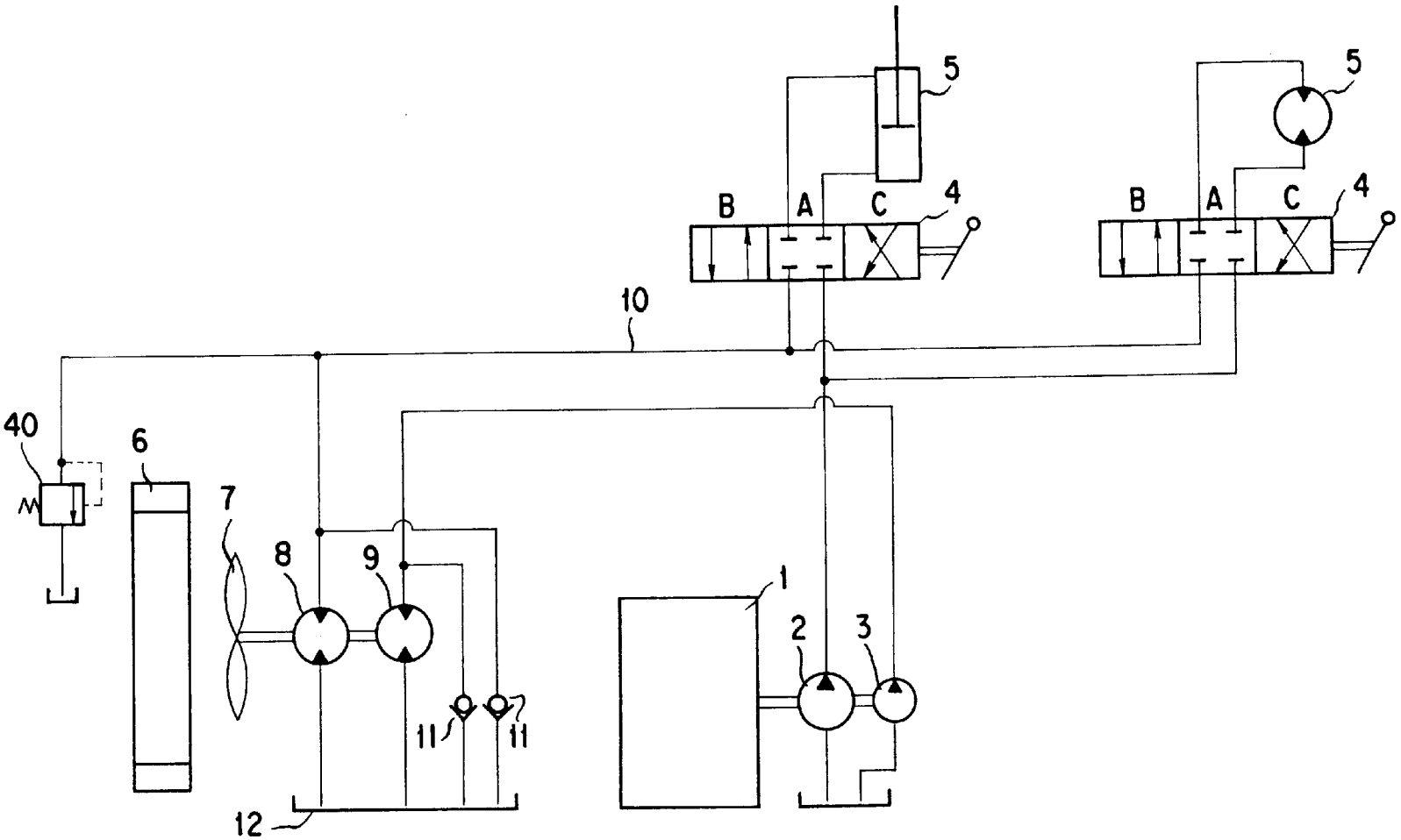
FIG. 3 is an explanatory illustration showing the second embodiment of the present invention.

As shown in FIG. 3, a back pressure valve 40 is provided in the return circuit 10. The pressurized fluid at upstream of the back pressure valve 40 is introduced into the first hydraulic rotary machine 8.

With such a construction, since the pressurized fluid at a pressure of a set pressure of the back pressure valve 40 is introduced into the first hydraulic rotary machine 8, the drive torque of the first hydraulic rotary machine 8 can be set at a set torque.

Figure 4:
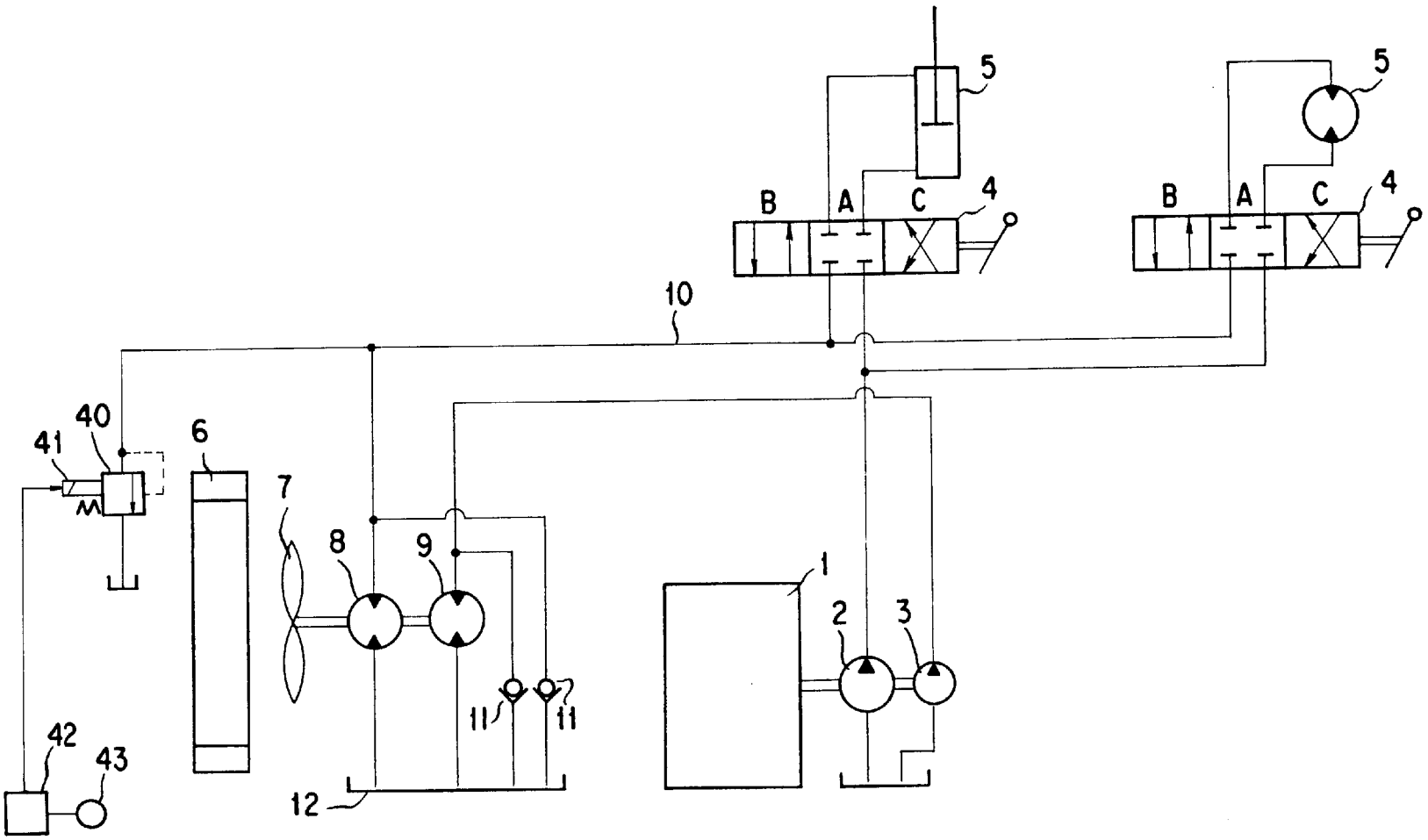
FIG. 4 is an explanatory illustration showing the third embodiment of the present invention.

As shown in FIG. 4, a set pressure of the back pressure valve 40 is variable depending upon a power supply amount to a solenoid 41. A detected temperature of a temperature sensor 43 is input to a controller 42 for controlling the power supply to the solenoid 41 so that the set pressure of the back pressure 40 is adjusted to a pressure proportional to the detected temperature by controlling the power supply amount to the solenoid 41 depending upon the detected temperature.

While the foregoing temperature sensor 43 is adapted to detect an engine coolant temperature, when the cooling fan 7 cools the engine oil cooler and working fluid cooler, an oil and a fluid temperature are detected, respectively. Also, when the primary hydraulic pump 2 and the auxiliary hydraulic pump 3 are to be cooled, a fluid temperature of the hydraulic circuit or a fluid temperature in the tank is detected.

With such a construction, the air blowing ability of the cooling fan 7 becomes a value depending upon a temperature of the cooling object to be efficiently cooled. Thus, the engine output power will not be wasted.

Figure 5:
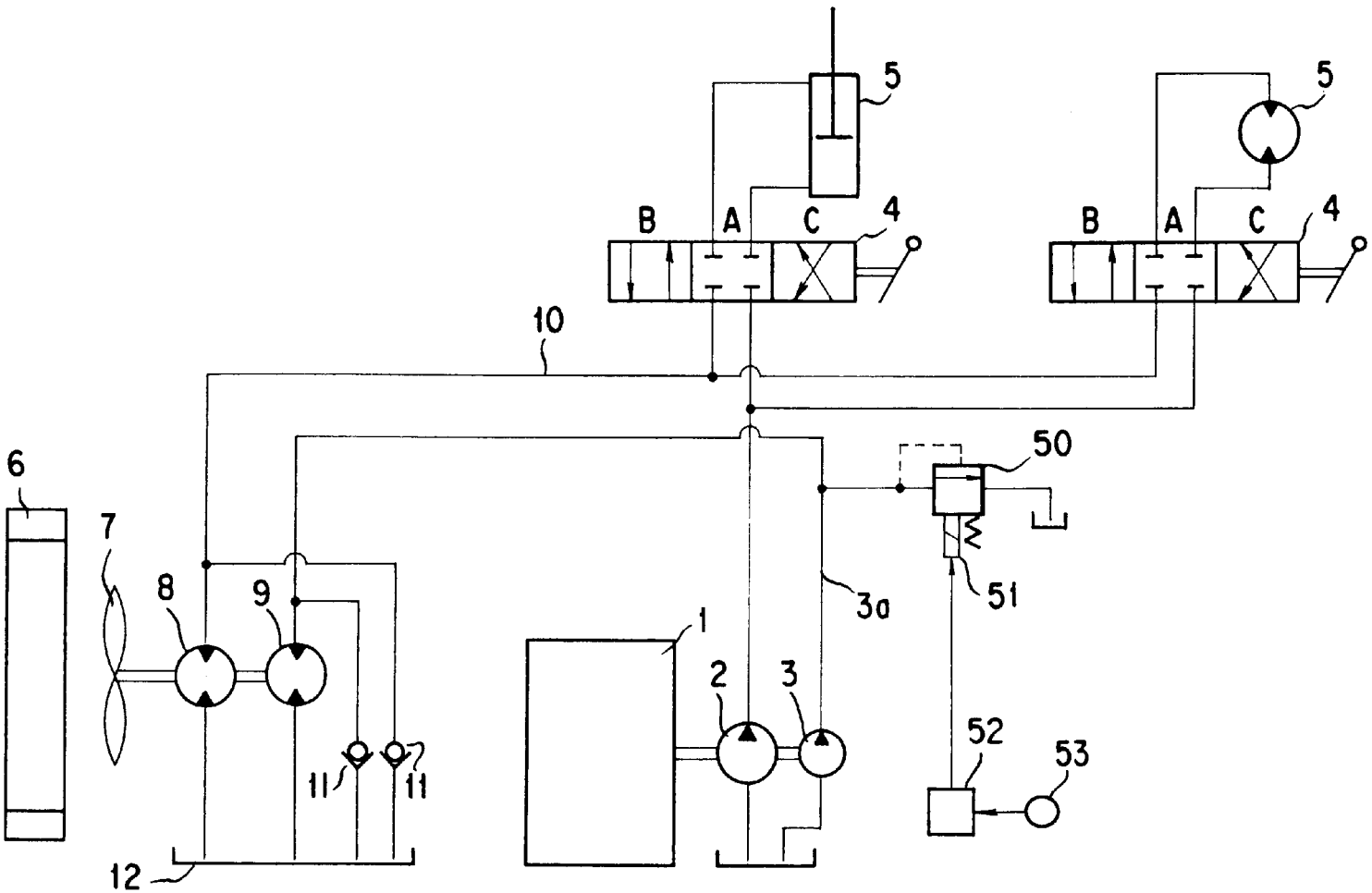
FIG. 5 is an explanatory illustration showing the fourth embodiment of the present invention.

As shown in FIG. 5, a variable relief valve 50 is provided in the discharge passage 3*a* of the auxiliary hydraulic pump 3. The relief set pressure of the variable relief valve 50 is varied depending upon a power supply amount to the solenoid 51. The power supply to the solenoid 51 is controlled by a controller 52, and a detected temperature of a temperature sensor 53 is input to the controller 52.

The foregoing temperature sensor 53 is similar to the temperature sensor 43 set forth above. When the detected temperature of the cooling object is higher than or equal to a set temperature, the controller 52 supplies a large current to the solenoid 51 for setting the relief pressure of the variable relief valve 50 at high pressure for preventing its relief operation, and when the temperature is lower than the set temperature, the power supply amount to the solenoid 51 is reduced to set the relief pressure at low pressure for enabling its relief operation.

With such a construction, when the cooling object is at a high temperature, high pressure is fed to the second hydraulic rotary machine 9 to cause its revolution at high torque so as to make the air blowing ability high. When the cooling object is at a low temperature, low pressure is fed to the second hydraulic rotary machine 9 to cause its revolution at low torque so as not to waste the engine output power.

Figure 6:
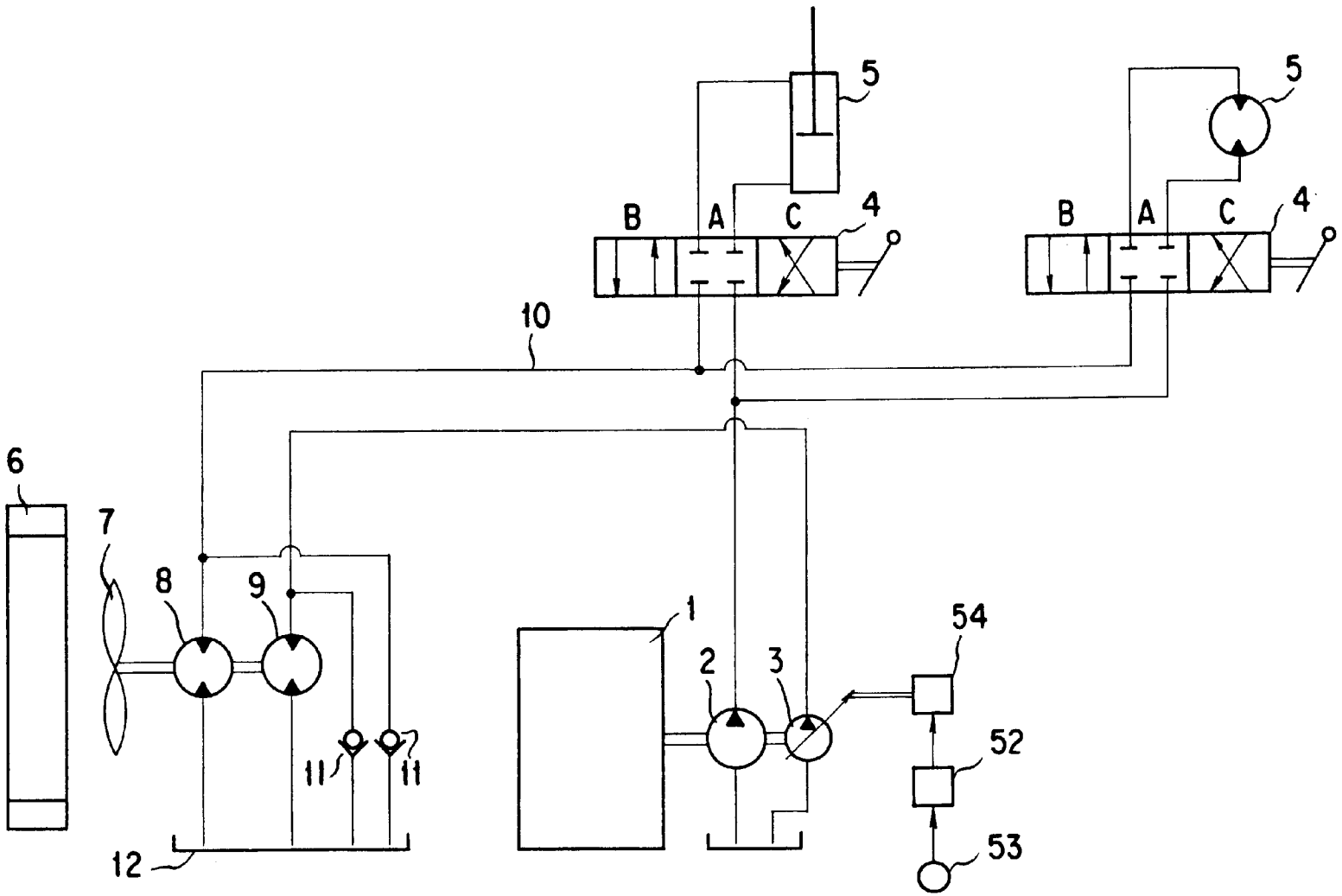
FIG. 6 is an explanatory illustration showing the fifth embodiment of the present invention.

As shown in FIG. 6, the auxiliary hydraulic pump 3 is a variable displacement type pump, in which a displacement control member 54 is controlled by the command from the controller 52 to increase and decrease its displacement.

Even with the construction set forth above, similar effects can be attained.

Figure 7:
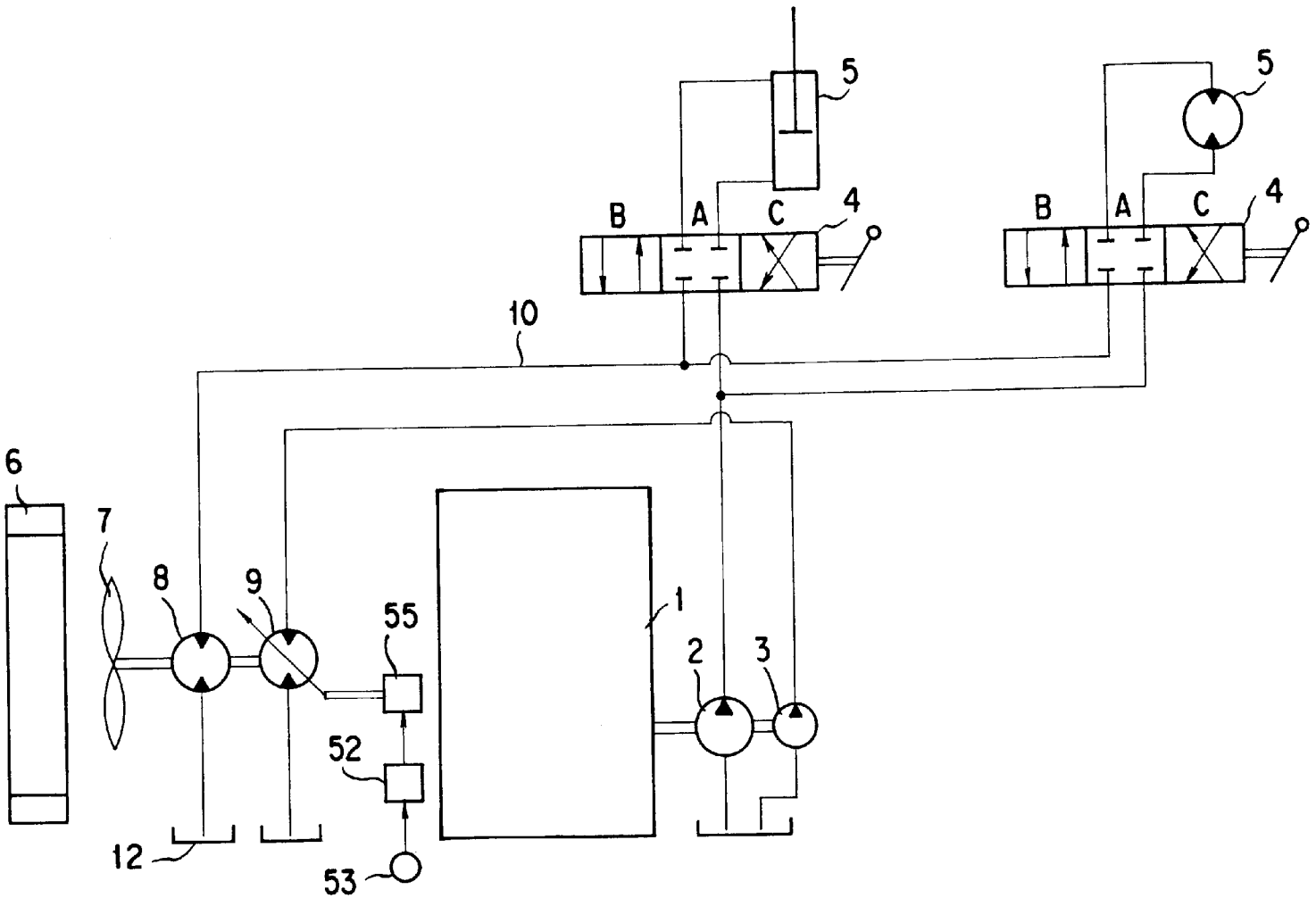
FIG. 7 is an explanatory illustration showing the sixth embodiment of the present invention.

As shown in FIG. 7, the second hydraulic rotary machine 9 is a variable displacement type hydraulic motor, and the displacement control member 55 therefor is controlled by the command from the controller 52 to increase and decrease its displacement.

Even with the construction set forth above, similar effects can be attained.

As set forth above, by controlling capacities of the variable type back pressure valve 40, the variable relief valve 50 and the auxiliary hydraulic pump 3 and the second hydraulic rotary machine 9 which is a variable displacement type hydraulic motor, a system for controlling the air blowing ability of the cooling fan 7 depending upon the temperature of the cooling object is archived.

Figure 8:
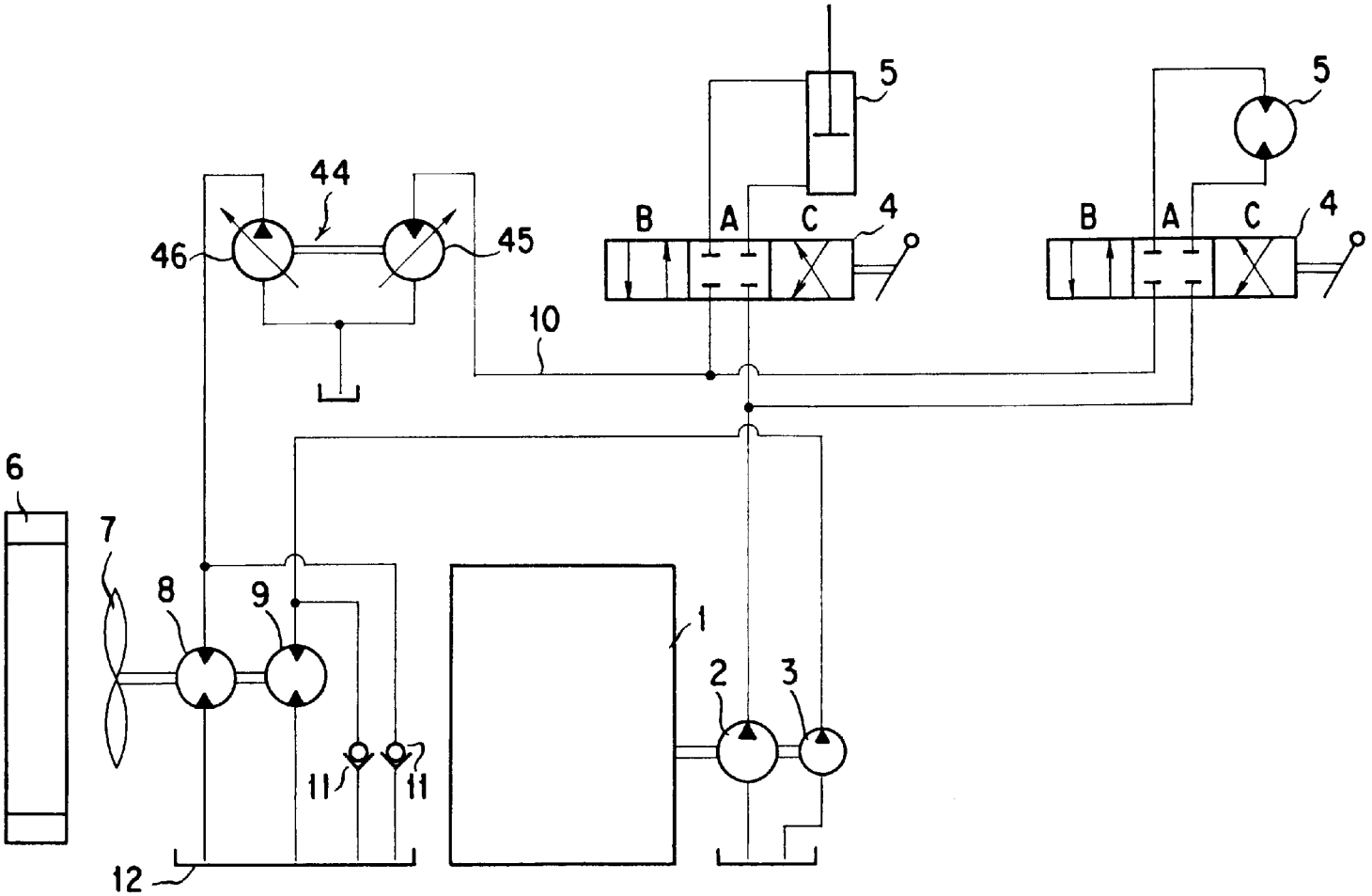
FIG. 8 is an explanatory illustration showing the seventh embodiment of the present invention.

As shown in FIG. 8, a pressure converter 44 is provided in the return circuit 10. The pressure converter 44 comprises first variable hydraulic motor 45 and second variable hydraulic pump 46 which are mechanically connected to each other for revolution at the same revolution speed. The return circuit 10 is connected to the first variable hydraulic motor 45 for its motoring operation. The second variable hydraulic pump 46 performs its pumping operation to discharge the pressurized fluid to the first hydraulic rotary machine 8.

As set forth above, by controlling the displacement of the second variable hydraulic pump 46, its discharge pressure can be varied arbitrarily. Therefore, the pressure to be supplied to the first hydraulic rotary machine 8 is set at an optimal pressure for driving the cooling fan 7.

Figure 9:
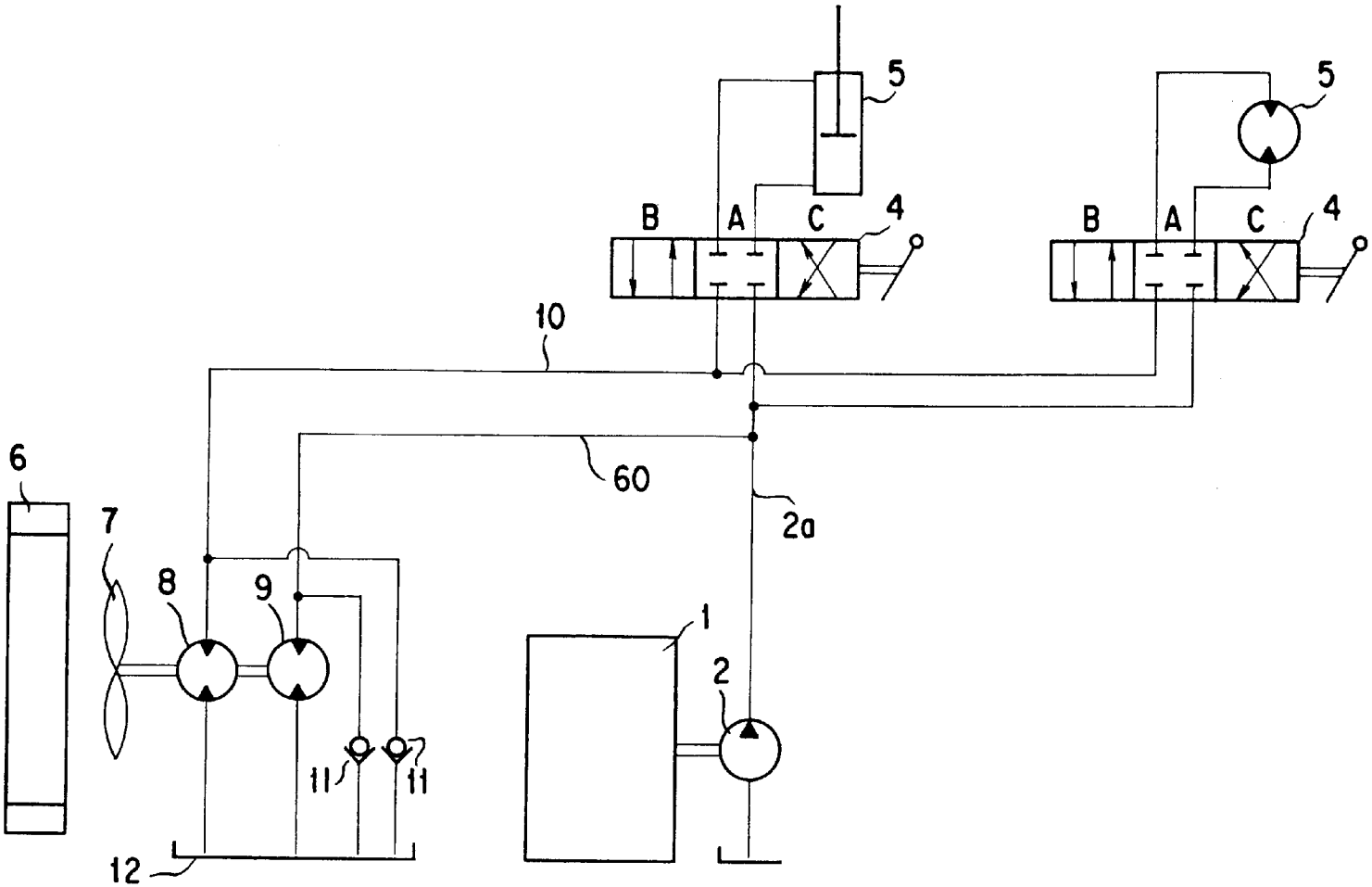
FIG. 9 is an explanatory illustration showing the eighth embodiment of the present invention.

As shown in FIG. 9, one end of a branch circuit 60 is connected to the discharge passage 2*a* of the primary hydraulic pump 2. The other end of the branch circuit 60 is connected to the second hydraulic rotary machine 9.

As set forth above, a part of the discharged pressurized fluid from the primary hydraulic pump 2 can rotate the second hydraulic rotary machine 9 to drive the cooling fan 7.

Figure 10:
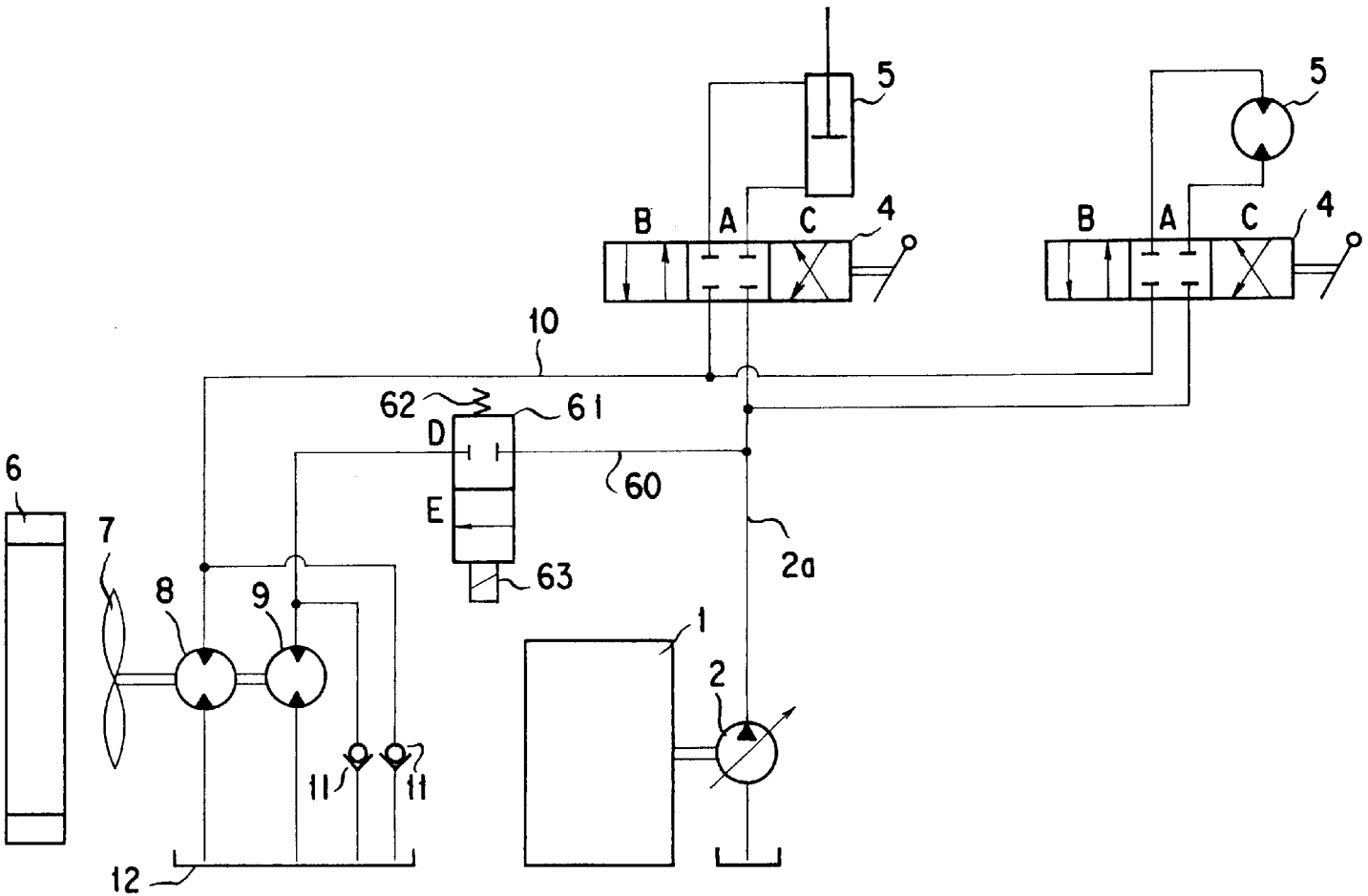
FIG. 10 is an explanatory illustration showing the ninth embodiment of the present invention.

As shown in FIG. 10, a switching valve 61 is provided in the branch circuit 60. The switching valve 61 is normally held at a closed position D by means of a spring 62, and is shifted to an open position E when an electric power is supplied to a solenoid 63. The electric power is supplied to the solenoid 63 when the operating valve 4 is switched to the first position B or to the second position C.

With this, while the actuator 5 is not actuated, the pressurized fluid is not supplied to the second hydraulic rotary machine 9 so as not to rotate. Also, when the actuator 5 is actuated, the pressurized fluid is supplied to the second hydraulic rotary machine 9 to rotate and thus increase the air blowing ability of the cooling fan 7 to sufficiently cool the engine.

Figure 11:
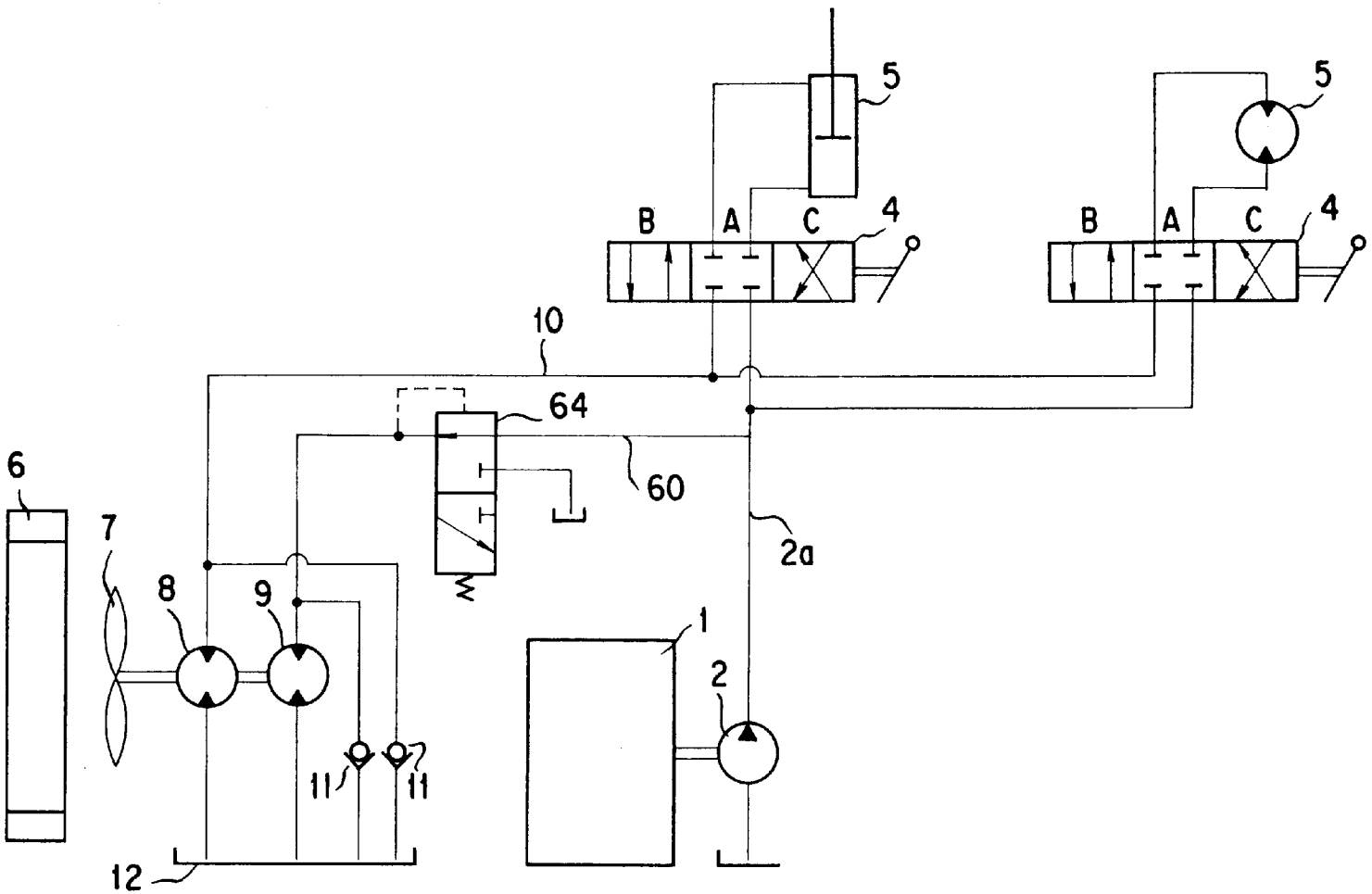
FIG. 11 is an explanatory illustration showing the tenth embodiment of the present invention.

As shown in FIG. 11, a pressure reduction valve 64 is provided in the branch circuit 60. Thus, since the pressurized fluid of a set pressure can be supplied to the second hydraulic rotary machine 9 to rotate irrespective of the discharge pressure of the primary hydraulic pump 2 for rotation, the second hydraulic rotary machine 9 can be rotated when the actuator 5 is actuated at high pressure.

Figure 12:
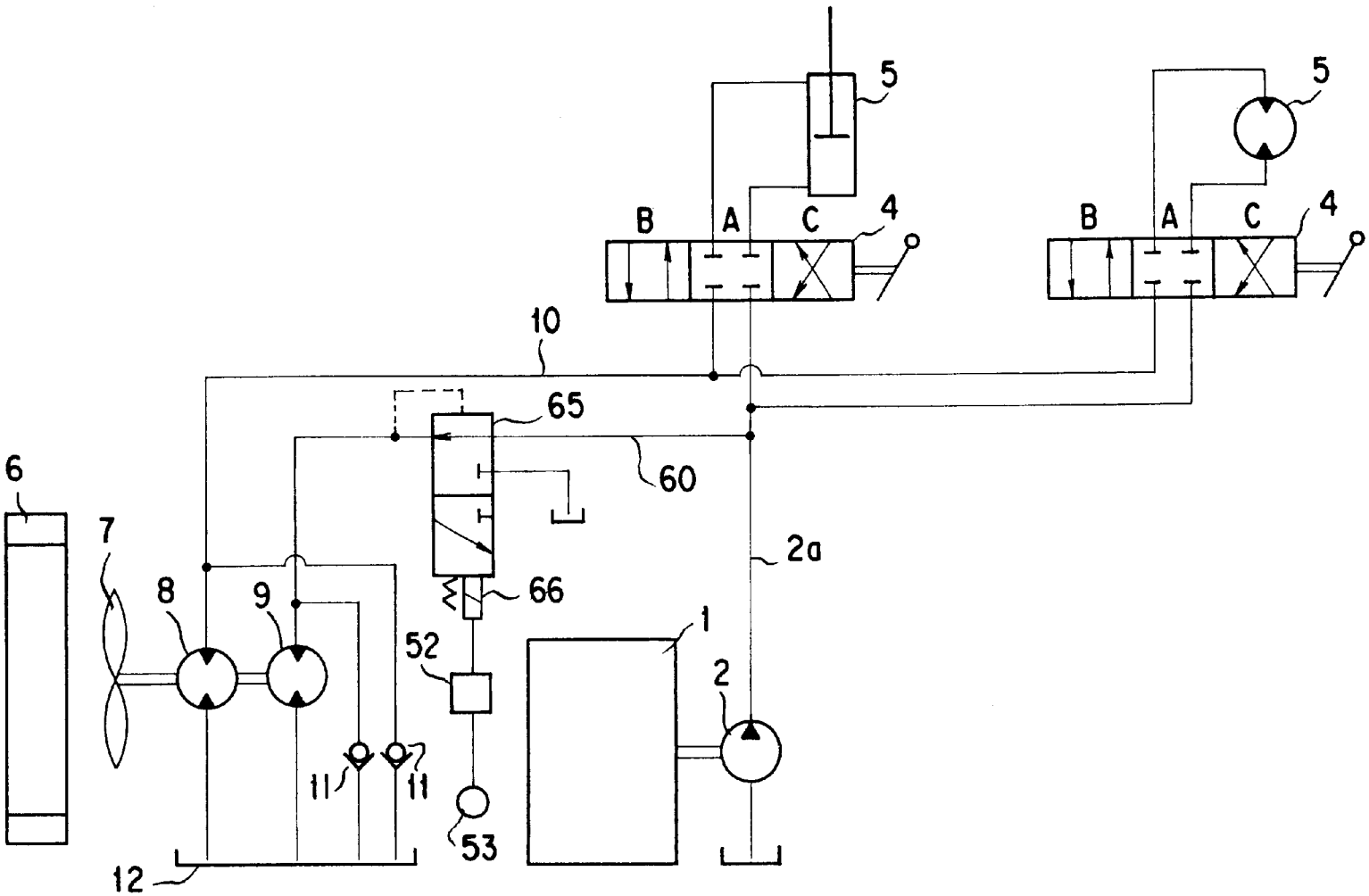
FIG. 12 is an explanatory illustration showing the eleventh embodiment of the present invention.

As shown in FIG. 12, a variable pressure reducing valve 65 is provided in the branch circuit 60. A set pressure of the variable pressure reducing valve 65 is proportional to a power supply amount to the solenoid 66. Similar to the foregoing, an electric power depending upon a detected temperature is supplied to the solenoid 66 by the controller 52.

With the construction set forth above, when the temperature of the cooling object is high, the set pressure of the variable pressure reducing valve 65 becomes high to supply the pressurized fluid of high pressure to the second hydraulic rotary machine 9 to make the air blowing ability of the cooling fan 7 large. Thus, an effective cooling can be performed.

Figure 13:
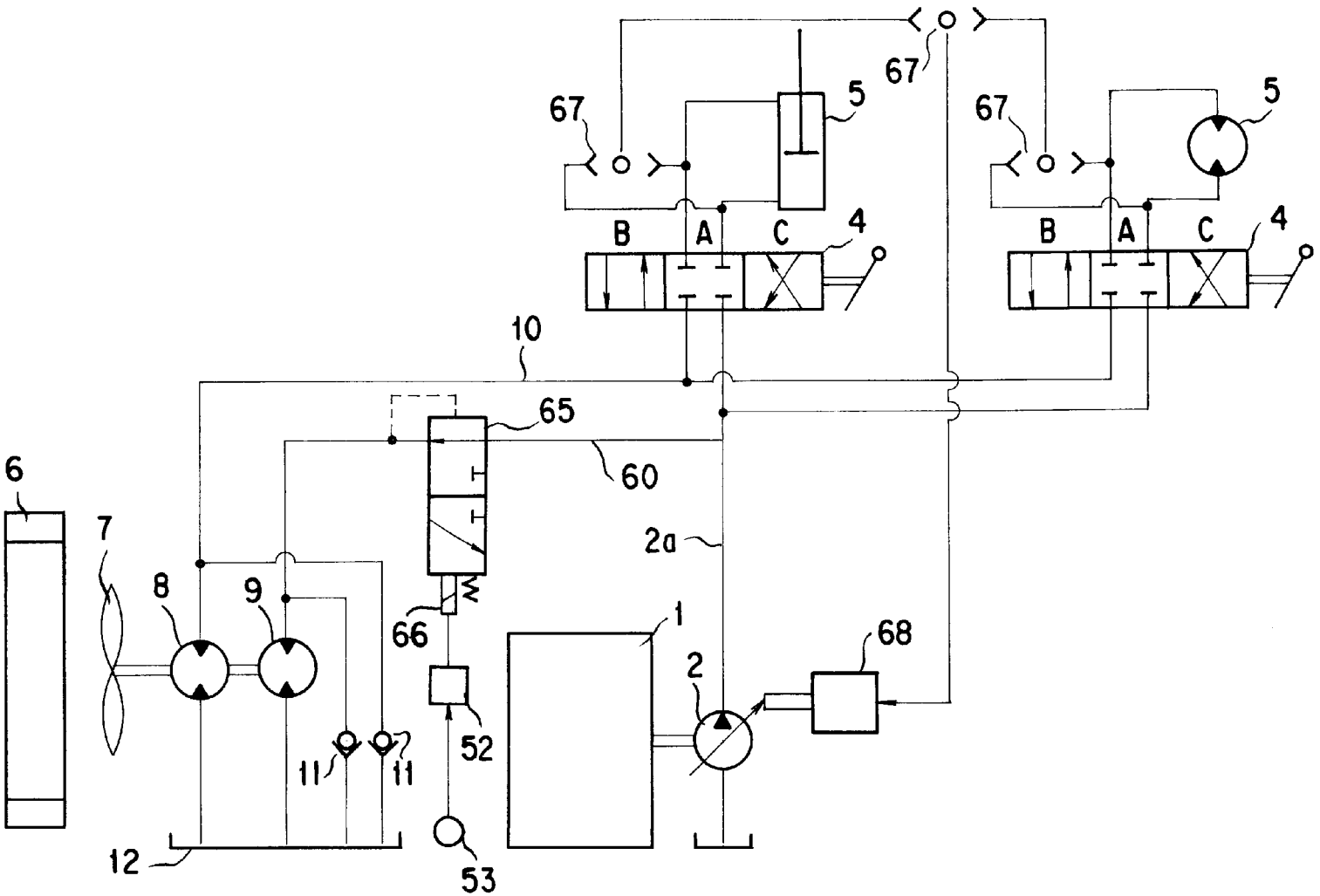
FIG. 13 is an explanatory illustration showing the twelfth embodiment of the present invention.

As shown in FIG. 13, one end of the branch circuit 60 is connected to the discharge passage 2*a* of the primary hydraulic pump 2, and the other end of the branch circuit 60 is connected to the second hydraulic rotary machine 9.

The highest load pressure among load pressures of a plurality of actuators 5 is detected by a plurality of shuttle valves 67. The primary hydraulic pump 2 is a variable displacement type pump, in which a displacement control member 68 is placed at a position corresponding to the highest load pressure.

With the construction set forth above, while the actuator 5 is not actuated, the load pressure becomes substantially zero to make the displacement of the primary hydraulic pump 2 minimum to make the pressure of the discharge passage 2*a* low. When the actuator 5 is actuated, the displacement becomes a value corresponding to the load pressure to make the pressure in the discharge passage 2*a* high.

What is claimed is:

1. A drive system for a cooling fan that blows air to a cooling object, said drive system comprising:

a primary hydraulic pump driven by an engine;

an operating valve that supplies a discharged pressurized fluid of the primary hydraulic pump to an actuator;

a first hydraulic rotary machine that rotates the cooling fan;

a second hydraulic rotary machine that rotates the cooling fan;

a return circuit that supplies a returning pressurized fluid from said operating valve to the first hydraulic rotary machine; and a hydraulic pressure source that is energized by the engine and that directly supplies pressurized fluid to the second hydraulic rotary machine;

wherein a hydraulic motor is driven by the returning pressurized fluid of said return circuit, a variable displacement type hydraulic pump is mechanically connected to the hydraulic motor to form a pressure converter, and a discharged pressurized fluid of the variable displacement type hydraulic pump is supplied to the first hydraulic rotary machine.

2. A drive system for a cooling fan that blows air to a cooling object, said drive system comprising:

a primary hydraulic pump driven by an engine;

an operating valve that supplies a discharged pressurized fluid of the primary hydraulic pump to an actuator;

a first hydraulic rotary machine that rotates the cooling fan;

a second hydraulic rotary machine that rotates the cooling fan;

a return circuit that supplies a returning pressurized fluid from said operating valve to the first hydraulic rotary machine; and a hydraulic pressure source that is energized by the engine and that directly supplies pressurized fluid to the second hydraulic rotary machine;

wherein the hydraulic pressure source comprises an auxiliary hydraulic pump driven by said engine.

3. A drive system as set forth in claim 2, wherein a controller is provided that sets a pressure of the pressurized fluid supplied from said auxiliary hydraulic pump to the second hydraulic rotary machine at high pressure when a temperature of the cooling object is high and at low pressure when the temperature of the cooling object is low.

4. A drive system as set forth in claim 2, wherein said first hydraulic rotary machine is a turbo type rotary machine, the cooling fan is a turbo fan, said second hydraulic rotary machine is a gear type hydraulic motor, the turbo fan is connected to one side portion of said turbo type rotary machine, and the gear type hydraulic motor is connected to another side portion of the turbo type rotary machine.

5. A drive system as set forth in claim 2, wherein a back pressure valve is provided in said return circuit, and an upstream side of the back pressure valve is connected to the first hydraulic rotary machine.

6. A drive system as set forth in claim 5, wherein said back pressure valve is provided with a controller that variably sets the back pressure valve at high pressure when a temperature of the cooling object is high, and at low pressure when the temperature of the cooling object is low.

7. A drive system for a cooling fan that blows air to a cooling object, said drive system comprising:

a primary hydraulic pump driven by an engine;

an operating valve that supplies a discharged pressurized fluid of the primary hydraulic pump to an actuator;

a first hydraulic rotary machine that rotates the cooling fan;

a second hydraulic rotary machine that rotates the cooling fan;

a return circuit that supplies a returning pressurized fluid from said operating valve to the first hydraulic rotary machine; and a hydraulic pressure source that is energized by the engine and that directly supplies pressurized fluid to the second hydraulic rotary machine;

wherein a pressurized fluid inflow side of said first hydraulic rotary machine and a pressurized fluid inflow side of said second hydraulic rotary machine are connected to a tank through a suction valve.

8. A drive system as set forth in claim 7, wherein a back pressure valve is provided in said return circuit, and an upstream side of the back pressure valve is connected to the first hydraulic rotary machine.

9. A drive system as set forth in claim 8, wherein said back pressure valve is provided with a controller that variably sets the back pressure valve at high pressure when a temperature of the cooling object is high, and at low pressure when the temperature of the cooling object is low.

10. A drive system as set forth in claim 7, wherein the hydraulic pressure source comprises a branch circuit connected to a discharge passage of said primary hydraulic pump.

11. A drive system as set forth in claim 10, wherein a variable pressure reduction valve is provided in said branch circuit, and a controller is provided to set a set pressure of said variable pressure reduction valve at high pressure when a temperature of the cooling object is high and at low pressure when the temperature of the cooling object is low.

* * * * *